US006239399B1

(12) United States Patent
Perret

(10) Patent No.: US 6,239,399 B1
(45) **Date of Patent: *May 29, 2001**

(54) INTERRUPTER WITH A RESISTOR INSERTION SYSTEM HAVING A LONG INSERTION TIME

(75) Inventor: Michel Perret, Bourgoin-Jallieu (FR)

(73) Assignee: Alstom France S.A., Paris (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/392,337

(22) Filed: Sep. 8, 1999

(30) Foreign Application Priority Data

Sep. 9, 1998 (FR) ..... 98 11244

(51) Int. Cl.[7] ..... H01H 33/18
(52) U.S. Cl. ..... 218/43; 218/43; 218/48
(58) Field of Search ..... 218/43, 45, 48, 218/49, 50, 51, 52, 53, 54, 63, 65, 143

(56) References Cited

U.S. PATENT DOCUMENTS 4,338,500 * 7/1982 Pham Van et al. ..... 218/154
4,393,291 * 7/1983 Stewart et al. ..... 218/143
4,996,399 * 2/1991 Thuries et al. ..... 218/43
5,276,285 * 1/1994 Pham et al. ..... 218/43
5,742,017 * 4/1998 Perret ..... 218/143
5,841,614 * 11/1998 Perret ..... 361/14

FOREIGN PATENT DOCUMENTS 2 737 937 2/1997 (FR) .
2 751 781 1/1998 (FR) .

* cited by examiner

*Primary Examiner*—Lincoln Donovan
(74) *Attorney, Agent, or Firm*—Sughrue, Mion, Zinn, Macpeak & Seas, PLLC

(57) ABSTRACT

In an interrupter with a resistor insertion system, the resistor insertion system comprises two auxiliary contacts, a first of which is electrically connected to a semi-mobile permanent current contact and the second of which is electrically connected to a fixed arc contact. The two auxiliary contacts are mounted to be mobile relative to each other along a longitudinal axis so as to be able to move toward each other when the interrupter closes to make a connection that short-circuits the resistor and so as to be constrained to move together along the longitudinal axis when the interrupter closes before making the connection which short-circuits the resistor, to increase the resistor insertion time.

6 Claims, 2 Drawing Sheets

OPEN POSITION

FIRST CLOSING POSITION

SECOND CLOSING POSITION

THIRD CLOSING POSITION

FOURTH CLOSING POSITION

FINAL CLOSED POSITION

INTERRUPTER WITH A RESISTOR INSERTION SYSTEM HAVING A LONG INSERTION TIME

BACKGROUND OF THE INVENTION

1. Field of the Invention

The invention concerns a compressed gas interrupter, in particular a high-tension circuit-breaker, comprising, in an enclosure which extends along a longitudinal axis, a first contact assembly including a first permanent current contact and a first arc contact, a second contact assembly mobile along the longitudinal axis relative to the first contact assembly and including a second permanent contact and a second arc contact respectively adapted to be connected to the first permanent contact and to the first arc contact, and a system for inserting a resistor when the interrupter closes, the resistor being electrically connected in series between the first arc contact and the first permanent current contact.

2. Description of the Prior Art

A resistor of the above kind limits the effects of transient currents in the grid when the interrupter is closed. In practice, the resistor is inserted during closing of the interrupter when an electrical connection is made between the arc contacts and is short-circuited before the connection between the permanent current contacts is made. The resistor must not be inserted when the interrupter is opened.

The resistor insertion time can vary from one installation to another. It is generally dependent on the speed at which the mobile contact assembly moves. Some interrupters have an insertion time in the order of 6 ms for a mobile contact assembly speed in the order of 4 m/s. Some installations require the use of interrupters which can produce a much longer resistor insertion time, in the order of 14 ms.

An aim of the invention is to propose a resistor insertion system with which a long resistor insertion time is obtained.

Another aim of the invention is to propose a closure resistor insertion system which is compact and has few component parts.

SUMMARY OF THE INVENTION

To this end, the invention consists in a compressed gas interrupter comprising, in an enclosure which extends along a longitudinal axis, a first contact assembly including a first permanent current contact and a first arc contact, a second contact assembly mobile along the longitudinal axis relative to the first contact assembly and including a second permanent contact and a second arc contact respectively adapted to be connected to the first permanent contact and to the first arc contact, and a system for inserting a resistor when the interrupter closes, the resistor being electrically connected in series between the first arc contact and the first permanent current contact, wherein the resistor insertion system comprises two auxiliary contacts a first of which is electrically connected to the first permanent current contact and the second of which is connected to the first arc contact, the two auxiliary contacts are mounted to be mobile relative to each other along the longitudinal axis so as to be able to move toward each other when the interrupter closes to make a connection that short-circuits the resistor and so as to be constrained to move together along the longitudinal axis when the interrupter closes before making the connection which short-circuits the resistor.

With the above arrangements, a resistor insertion time is obtained corresponding to the time needed for the two auxiliary contacts to move toward each other plus the travel time of the two auxiliary contacts when they are constrained to move together.

In one particular embodiment of the interrupter of the invention, the first arc contact is in the form of a rod on which slides a metal block carrying the second auxiliary contact and the block is pushed along the longitudinal axis when the interrupter closes by a nozzle fastened to the second arc contact. The resistor insertion time can therefore be adjusted to suit the speed of the mobile contact assembly.

In another embodiment of the interrupter of the invention, the block has a substantially conical end which nests inside the nozzle. This eliminates the effect of impact on the block when the interrupter closes, which contributes to moving the block at the same speed as the mobile contact.

In a further embodiment of the interrupter of the invention, the block has a tubular extension which extends along the longitudinal axis and on which slides an insulative member fastened to the first auxiliary contact, the tubular extension having one end forming a piston which cooperates with a recess in the insulative member so that the piston is fastened to the insulative member when the interrupter closes by virtue of a pressure drop created in the recess in the insulative part between the piston and the insulative part. The auxiliary contacts are therefore constrained to move together, when the interrupter closes, by a simple pneumatic system employing a suction effect that does not require any linkage.

In a further embodiment of the interrupter of the invention, the block comprises an internal chamber which is divided by a radial shoulder of the rod of the first arc contact and a ring is placed in the chamber against the radial shoulder of the rod so that displacement of the block along the rod of the first arc contact when the interrupter closes compresses the spring at the same time as the chamber fills with gas and, when the interrupter opens, the spring on expanding applies a return force which tends to move the block automatically in the opposite direction at the same time as the gases are expelled from the chamber via an orifice therein, the orifice being sized to oppose the return force of the spring. These arrangements procure disconnection of the auxiliary contacts when the interrupter opens which is effective only after disconnection of the arc contacts and the permanent current contacts, in a simple manner, with few component parts and by pneumatic means. Accordingly, the resistor cannot be inserted when the interrupter opens.

In a further embodiment of the interrupter of the invention, the first auxiliary contact and the first permanent current contact are mounted on and fastened to a tube mobile along the longitudinal axis and a spring is placed against the mobile tube to oppose movement of the tube along the longitudinal axis when the interrupter closes, the spring exerting a return force when the interrupter opens which tends to move the tube automatically in the opposite direction along the longitudinal axis.

One embodiment of an interrupter in accordance with the invention is described in more detail below and shown in the drawings.

DETAILED DESCRIPTION OF THE PREFERRED EMBODIMENT

Figure 1:
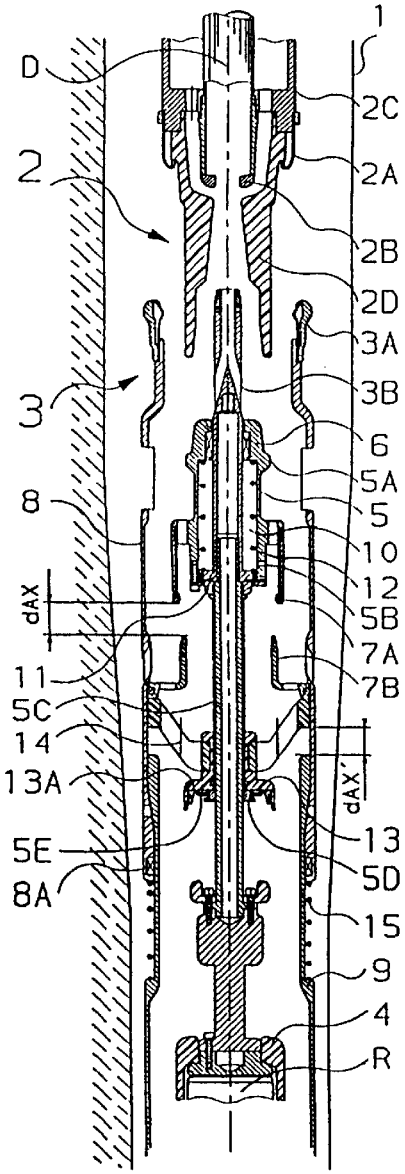
FIG. 1 is a highly diagrammatic representation of an interrupter in accordance with the invention in a fully open configuration.

The interrupter shown in the figures, and more particularly in FIG. 1, is an interrupter used for very high voltages. It has an insulative, for example porcelain, or metal enclosure 1 of substantially cylindrical shape extending along a longitudinal axis D and containing a first contact assembly 2 which is mobile along the axis D and a second contact assembly 3. The enclosure is normally filled with an insulative gas such as $SF_6$ at a pressure of a few bars to form an interrupter chamber.

The interrupter shown in the figures is a symmetrical body of revolution about the axis D.

The interrupter comprises at the same end of the interrupter chamber as the contact assembly 3 a resistor R which is conventionally inserted into the electrical circuit of the interrupter when it closes.

The mobile contact assembly 2 includes a permanent current contact 2A in the form of a ring of metal fingers and a hollow arc contact 2B which is also in the form of a ring of metal fingers, the hollow arc contact 2B being coaxial with the contact 2A about the axis D. The mobile contacts 2A and 2B are carried by a tube 2C equipped with a gas compressor piston (not shown) for extinguishing the arc when the interrupter opens, in the conventional way. The tube 2C also carries a gas nozzle 2D whose diverging portion, which is coaxial with the contacts 2A and 2B about the axis D, opens via a tulip-shaped diverging portion at the same end as the contact assembly 3. The contact assembly 2A, 2B with the nozzle 2D is moved in translation along the axis D by an interrupter operating unit that is not shown.

In alignment with the mobile contact assembly 2, the contact assembly 3 comprises a permanent current contact 3A which is in the form of a ring of metal fingers coaxial with the ring of fingers of the contact 2A about the axis D and an arc contact in the form of a rod 3B (which can be a hollow rod) extending along the axis D coaxially with the ring of fingers of the contact 2B. When the interrupter closes, the arc contact in the form of the rod 3B is inserted in the hollow mobile arc contact 2D through the nozzle 2D and the contact 3A engages with the contact 2A.

The resistor R is held in an insulative support 4 which is fastened to the arc contact rod 3B and extends along the axis D. The resistor R is electrically connected in series between the arc contact 3B and the permanent current contact 3A, although this is not shown in the figures.

A metal block 5 is mounted to slide on the rod 3B and is in electrical contact with the rod via concertina contacts 6. The block 5 has a substantially conical end adapted to be inserted into the divergent portion of the neck of the nozzle and has a peripheral bead 5A on the outside surface of the conical end against which the edge of the opening in the divergent portion of the nozzle 2D abuts.

The block 6 carries a first auxiliary arc contact 7A in the form of a ring of fingers which cooperates with a second auxiliary arc contact 7B in the form of a tube, the auxiliary arc contacts 7A and 7B short-circuiting the resistor R when the interrupter closes.

To be more precise, the fingers of the contact 7A extend along the axis D toward the resistor R and the contact tube 7B extends in the opposite direction, i.e. toward the mobile contact assembly 2.

The auxiliary contact 7B is electrically connected to the permanent current contact 3A by a metal tube 8 which is mounted to move along the axis D in the enclosure 1 on another metal tube 9 fixed into the enclosure and surrounding the resistor R. The metal tube 8 is in electrical contact with the metal tube 9 via sliding contacts 8A.

The block 5 which carries the auxiliary contact 7A includes an internal chamber 10 through which the rod 3B of the fixed arc contact of the assembly 3, on which it slides, passes in a sealed manner. The chamber 10 is divided by a radial shoulder 11 on the rod 3B (forming a kind of piston) on which a spring 12 bears. The chamber 10 includes orifices 5B enabling gas to escape from the interior of the chamber 10. The spring 12 is compressed when the block 5 is moved downward along the axis D in FIG. 1.

The block 5 is extended by a tubular portion 5C which extends along the axis D and surrounds the rod 3B. An insulative member 13 is mounted to slide on the tubular portion 5C. The tubular portion 5C has an enlarged perimeter which forms a piston 5D adapted to be inserted into a complementary recess 13A in the member 13. The piston 5D includes valves 5E oriented so that the gases in the recess 13A can escape from the recess when the piston 5D is inserted into the recess.

The member 13 is fastened to the tube 8 by means of an insulative support cone 14 so that the tube 8 and consequently the contacts 3A and 7B are constrained to move with the insulative member 14 along the axis D.

A spring 15 between the tube 8 and a shoulder on the tube 9 is compressed when the tube 8 is moved downward along the axis D in FIG. 1. Furthermore, the downward stroke of the tube 8 in FIG. 1 is stopped by an abutment formed by the end of the tube 9 and the insulative cone 14.

As shown in FIG. 1, when the interrupter is in the fully open configuration, the auxiliary arc contacts 7A and 7B are separated by a distance dAX which is varied to adjust the resistor insertion time when the interrupter closes. Furthermore, the resistor insertion time can be adjusted by varying the distance dAX' which corresponds to the travel of the tube 8 before the insulative cone abuts against the edge of the tube 9.

The resistor insertion system operates in the following manner when the interrupter closes.

In FIG. 1, in which the interrupter is in the fully open configuration. The contacts 2A, 2B and 7A are respectively separated from the contacts 3A, 3B and 7B. The piston 5D is fully depressed in the recess 13A. There is no gas at the interface between the piston 5D and the insulative member 13, which creates a drop in pressure.

Figure 2:
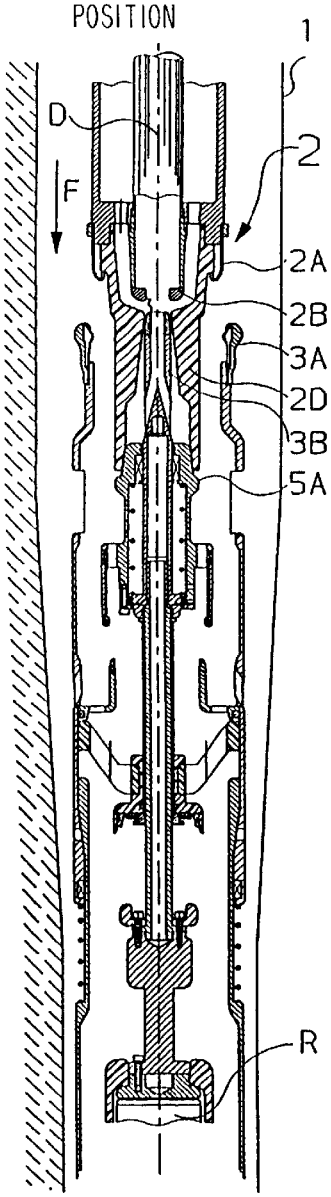
FIG. 2 is a highly diagrammatic representation of the interrupter from FIG. 1 in a first intermediate closing configuration.

In FIG. 2, closing of the interrupter has begun. The assembly 2 begins a closing stroke along the axis D, in the direction indicated by the arrow F. The contacts 2A and 2B are moved toward the contacts 3A and 3B and an electrical arc is first struck between the arc contacts 2B and 3B. The current therefore flows from the arc contact 2B to the arc contact 3B. By design, the distance dAX is sufficiently large to prevent arcing between the auxiliary contacts 7A and 7B. The current therefore flows through the rod of the arc contact 3B and the resistor R which is inserted into the electrical circuit of the interrupter. During this first phase of closing, the nozzle 2D moves at the same time as the contacts 2A and 2B and strikes the bead 5A on the conical surface of the front end of the block 5. However, this conical end of the block 5 has first been gradually inserted into the tulip-shaped divergent portion of the nozzle 2D and therefore moves without oscillation due to the impact.

Figure 3:
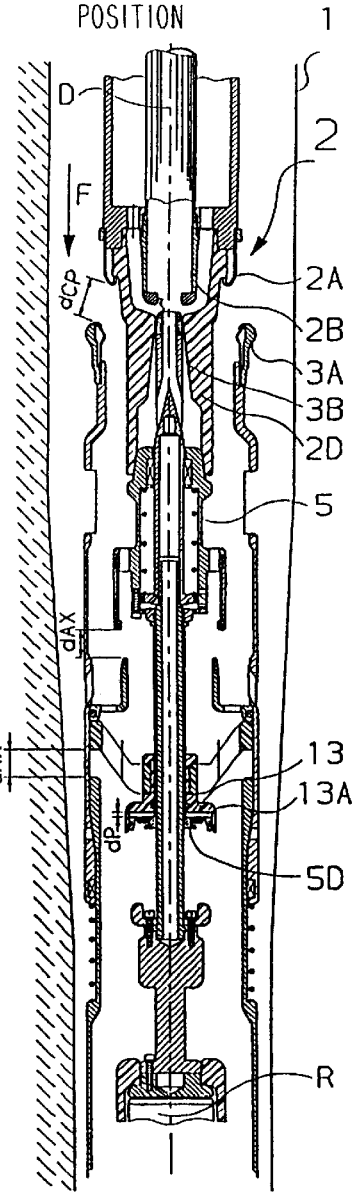
FIG. 3 is a highly diagrammatic representation of the interrupter from FIG. 1 in a second intermediate closing configuration.

In FIG. 3, the assembly 2 has moved slightly in the direction of the arrow F relative to the FIG. 2 position. The contacts 2A and 2B have therefore moved closer to the contacts 3A and 3B but the distance dCP between the contacts 2A and 3A is still sufficient to prevent the arcing. Pushed by the nozzle 2D, the block 5 has also moved slightly in the direction of the arrow F along the axis D, which has caused a corresponding displacement dP of the piston 5D in the recess 13A in the insulative member 13. This slight movement has created a drop in pressure at the interface between the piston 5D and the insulative member 13. Note that the distance dAX between the auxiliary arc contacts 7A and 7B has also decreased slightly, but remains sufficiently large to prevent striking of an arc between these contacts. The current is still flowing in the arc contact 2B, the arc contact 3B and the inserted resistor R.

Figure 4:
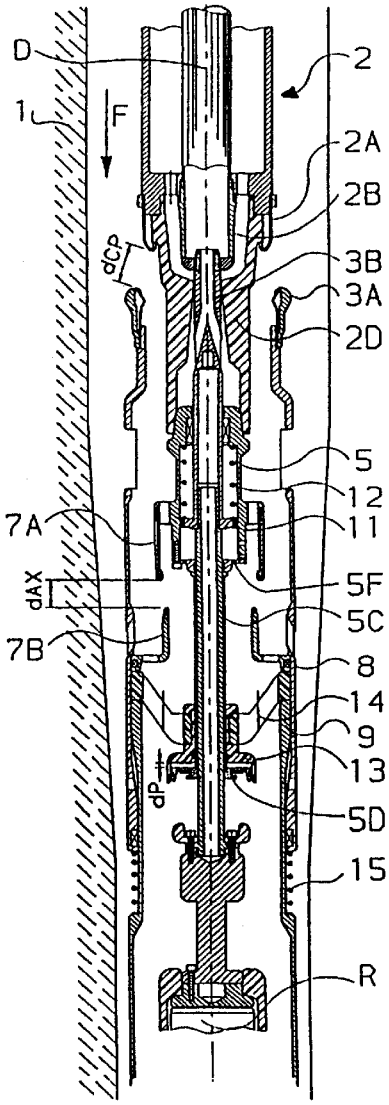
FIG. 4 is a highly diagrammatic representation of the interrupter from FIG. 1 in a third intermediate closing configuration.

In FIG. 4, the assembly 2 has moved farther in the direction of the arrow F from its FIG. 3 position. The arc contact 3B in the form of the rod is now inserted into the hollow arc contact 2B and the permanent current contacts 2A and 3A are still separated by a sufficient distance dCP to prevent arcing. Moving with the contacts 2A and 2B, the nozzle 2D has pushed the block 5 in the direction of the arrow F along the axis D, causing the spring 12 to be compressed between the shoulder 11 and the block 5 and gas to enter the chamber 10 of the block 5 through a valve 5F. In parallel with the above, the piston 5D at the end of the tubular portion 5C of the block 5 has drawn the insulative member 13 in the direction of the arrow F by suction, with the result that the tube 8 has also moved in the direction of the arrow F along the axis D, compressing the spring 15. It is to be understood that the power of the spring 15 must be less than the suction force exerted by the piston 5D on the insulative member 13. Because the tube 8 and the block 5 have moved together and in the same direction, the auxiliary arc contacts 7A and 7B have remained separated by a distance dAX sufficiently large to prevent arcing. Consequently, the current is still flowing in the arc contact 2B, the arc contact 3B and the resistor R, which is still inserted. In FIG. 4, the support cone 14 is abutted against the end of the tube 9, which prevents the tube 8 from moving in the direction of the arrow F along the axis D.

Figure 5:
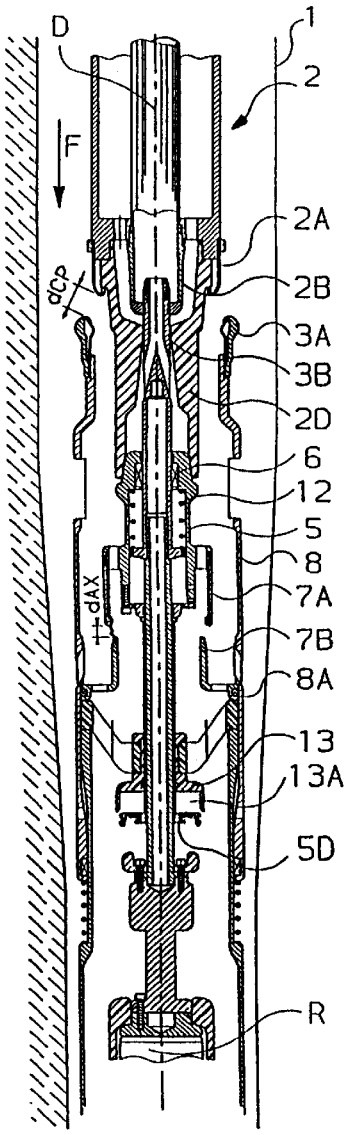
FIG. 5 is a highly diagrammatic representation of the interrupter from FIG. 1 in a fourth intermediate closing configuration.

In FIG. 5, the assembly 2 has moved in the direction of the arrow F relative to its position in FIG. 4. The arc contact 3B in the form of the rod has been inserted a greater distance into the hollow arc contact 2B and the permanent current contacts 2A and 3A are still close together, although at a sufficiently large distance to prevent arcing. The nozzle 2D has pushed the block 5 farther in the direction of the arrow F and the spring 12 has been compressed further. Because the tube 8 is against an abutment in the direction of the arrow F, the nozzle 2D pushing on the lock 5 causes the piston 5D to be withdrawn from the recess 13A in the insulative member 13. This eliminates the suction effect. The auxiliary arc contact 7A moves toward the auxiliary arc contact 7B until the distance dAX is sufficiently small for arcing to occur between these two contacts. This connection between the two contacts 7A and 7B short-circuits the resistor R and so the current flows through the arc contact 2B, the arc contact 3B, the concertina contacts 6, the metal block 5, the auxiliary arc contact 7A, the auxiliary arc contact 7B, the tube 8, the concertina contact 8A and the tube 9.

Figure 6:
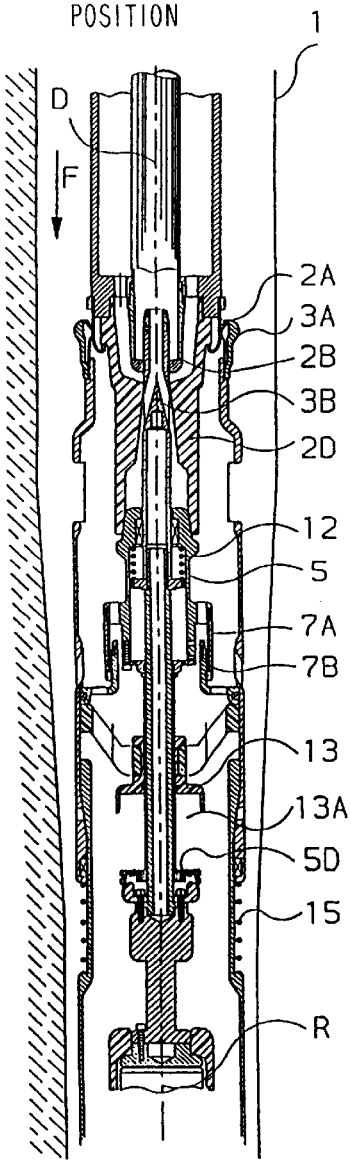
FIG. 6 is a highly diagrammatic representation of the interrupter from FIG. 1 in a fully closed configuration.

In FIG. 6, the interrupter is completely closed. The contacts 2A, 2B and 7A are connected to the respective contacts 3A, 3B and 7B. The connection between the permanent current contacts 2A and 3A is made after the connection of the auxiliary arc contacts 7A and 7B. Compared to the configuration of the interrupter shown in FIG. 5, the block 5 has been pushed farther in the direction of the arrow F by the nozzle 2D and the spring 12 has been compressed further. Because the piston 5D was no longer constrained to move with the insulative member 13, the spring 15 has expanded and exerted a return force which has moved the tube 8 and therefore the contacts 3A and 7B in the direction opposite the arrow F. The tube 8 has therefore returned to the position it occupied in FIG. 1 when the interrupter was completely open.

When the interrupter opens, the assembly 2 is moved at high speed with the nozzle 2D in the direction opposite the arrow F. The permanent current contacts 2A and 3A separate first, and then the arc contacts 2B and 3B. Because it is no longer pushed by the nozzle 2D, the block 5 automatically moves in the same direction as the mobile assembly 2 because of the return force exerted by the spring 12 (which expands), at the same time as the gases in the chamber 10 of the block 5 escape via the orifices 5B. As mentioned above, these orifices are sized so that a resistance is exerted to the return force of the spring 12 so that the block 5 moves more slowly than the assembly 2 in the direction opposite the arrow F. As a result the auxiliary arc contacts 7A and 7B remain connected after the arc contacts 2B and 3B separate and the resistor therefore remains short-circuited when the interrupter opens. When the block 5 returns to the position it occupies in FIG. 1, the piston 5D is again inserted in the recess 13A in the insulative member 13 and the gases at the interface between the piston SD and the insulative member 13 are expelled via the valve 5E.

There is claimed:

1. A compressed gas interrupter having an enclosure which extends along a longitudinal axis, said interrupter comprising:

a first contact assembly including a first permanent current contact and a first arc contact, a second contact assembly movable along said longitudinal axis relative to said first contact assembly and including a second permanent contact and a second arc contact, and a system for inserting a resistor when said interrupter closes and said second permanent contact and said second arc contact are respectively connected to said first permanent current contact and said first arc contact, said resistor being electrically connected in series between said first arc contact and said first permanent current contact, wherein said resistor insertion system comprises:

two auxiliary contacts, a first of which is electrically connected to said first permanent current contact and a second of which is connected to said first arc contact, and wherein said two auxiliary contacts are movable relative to each other along said longitudinal axis to move toward each other when said interrupter closes to make a connection that short-circuits the resistor, said two auxiliary contacts which connect to each other and to move together, while connected, along said longitudinal axis to short-circuit said resistor prior to connection between said first permanent current contact and said second permanent current contact.

2. The interrupter claimed in claim 1, wherein said first arc contact is a rod on which slides a metal block carrying said second auxiliary contact and said block is pushed along said longitudinal axis when said interrupter closes by a nozzle fastened to said second arc contact.

3. The interrupter claimed in claim 2, wherein said block has a substantially conical end which nests inside said nozzle.

4. The interrupter claimed in claim 2, wherein said block has a tubular extension which extends along said longitudinal axis and an insulative member fastened to said first auxiliary contact, said insulative member which slides on said tubular extension, and a piston formed at one end of said tubular extension which cooperates with a recess in said insulative member so that a displacement of said piston in said recess causes a pressure drop at an interface between said piston and said insulative member, and said piston is fastened to said insulative member when said interrupter closes by virtue of said pressure drop.

5. The interrupter claimed in claim 2, wherein said block comprises:

an internal chamber which is divided by a radial shoulder of said rod of said first arc contact, and a spring disposed in said chamber against said radial shoulder of said rod so that a displacement of said block along said rod of said first arc contact when said interrupter closes, compresses said spring at a same time as said chamber fills with gas and, and when said interrupter opens, said spring on expanding, applies a return force which moves said block automatically in an opposite direction at a same time as said gases are expelled from said chamber via an orifice therein, said orifice being of a size such that a resistance is exerted to a return force of said spring when said gases are expelled.

6. The interrupter claimed in claim 1, wherein said first auxiliary contact and said first permanent current contact are mounted on and fastened to a tube which is movable along said longitudinal axis and a spring is placed against said tube to oppose movement of said tube along said longitudinal axis when said interrupter closes, said spring exerting a return force when said interrupter opens which moves said tube automatically along said longitudinal axis in an opposite direction.

* * * * *